US006991427B2

(12) United States Patent
Scott

(10) Patent No.: US 6,991,427 B2
(45) Date of Patent: Jan. 31, 2006

(54) CASING SECTION

(75) Inventor: John M Scott, Worksop (GB)

(73) Assignee: Rolls-Royce plc, London (GB)

( * ) Notice: Subject to any disclaimer, the term of this patent is extended or adjusted under 35 U.S.C. 154(b) by 43 days.

(21) Appl. No.: 10/425,639

(22) Filed: Apr. 30, 2003

(65) Prior Publication Data

US 2003/0206799 A1 Nov. 6, 2003

(30) Foreign Application Priority Data

May 2, 2002 (GB) ..... 0210042

(51) Int. Cl.
*F01D 9/04* (2006.01)
*F01D 11/12* (2006.01)

(52) U.S. Cl. ..... 415/209.3; 415/173.4

(58) Field of Classification Search ... 415/209.1–209.4, 415/115, 178, 217, 136, 210.1, 199, 208.2, 415/189–192, 173.4
See application file for complete search history.

(56) References Cited

U.S. PATENT DOCUMENTS

| | | | | | |
|---|---|---|---|---|---|
| 3,070,353 | A | | 12/1962 | Welsh | |
| 3,650,635 | A | * | 3/1972 | Wachtell et al. | 415/115 |
| 3,728,041 | A | * | 4/1973 | Bertelson | 415/189 |
| 3,781,125 | A | * | 12/1973 | Rahaim et al. | 415/115 |
| 3,837,761 | A | * | 9/1974 | Brown | 416/191 |
| 4,180,371 | A | * | 12/1979 | Ivanko | 415/115 |
| 4,655,682 | A | * | 4/1987 | Kunz et al. | 415/119 |
| 4,850,090 | A | * | 7/1989 | Catlow | 29/889.22 |
| 5,154,577 | A | * | 10/1992 | Kellock et al. | 415/170.1 |
| 5,197,856 | A | * | 3/1993 | Koertge et al. | 415/209.3 |
| 5,269,057 | A | * | 12/1993 | Mendham | 29/889.1 |
| 5,293,717 | A | * | 3/1994 | Snyder et al. | 451/5 |
| 5,429,478 | A | * | 7/1995 | Krizan et al. | 415/173.7 |
| 5,669,757 | A | | 9/1997 | Brackett | |
| 5,791,871 | A | * | 8/1998 | Sech et al. | 415/173.1 |
| 5,962,076 | A | * | 10/1999 | Mason et al. | 427/376.2 |
| 6,076,835 | A | * | 6/2000 | Ress et al. | 277/637 |
| 6,148,518 | A | * | 11/2000 | Weiner et al. | 29/889.2 |
| 6,416,278 | B1 | * | 7/2002 | Caddell et al. | 415/191 |
| 2002/0044868 | A1 | | 4/2002 | Mars | |

FOREIGN PATENT DOCUMENTS

| | | | |
|---|---|---|---|
| EP | 1112146 | A | 7/2001 |
| GB | 1287223 | P | 8/1972 |
| GB | 2110768 | A | 6/1983 |
| GB | 2136508 | A | 9/1984 |
| GB | 2327466 | A * | 1/1999 |

* cited by examiner

*Primary Examiner*—Edward K. Look
*Assistant Examiner*—Richard A Edgar
(74) *Attorney, Agent, or Firm*—W. Warren Tatavull; Manelli Denison & Selter PLLC

(57) ABSTRACT

A casing section (30) for rotary apparatus (13, 14) of a gas turbine engine (10) is described. The casing section (30) comprises a partially circumferential casing member (32) and a plurality of radially inwardly extending vanes (34) fixed on the casing member (32).

20 Claims, 3 Drawing Sheets

Prior Art

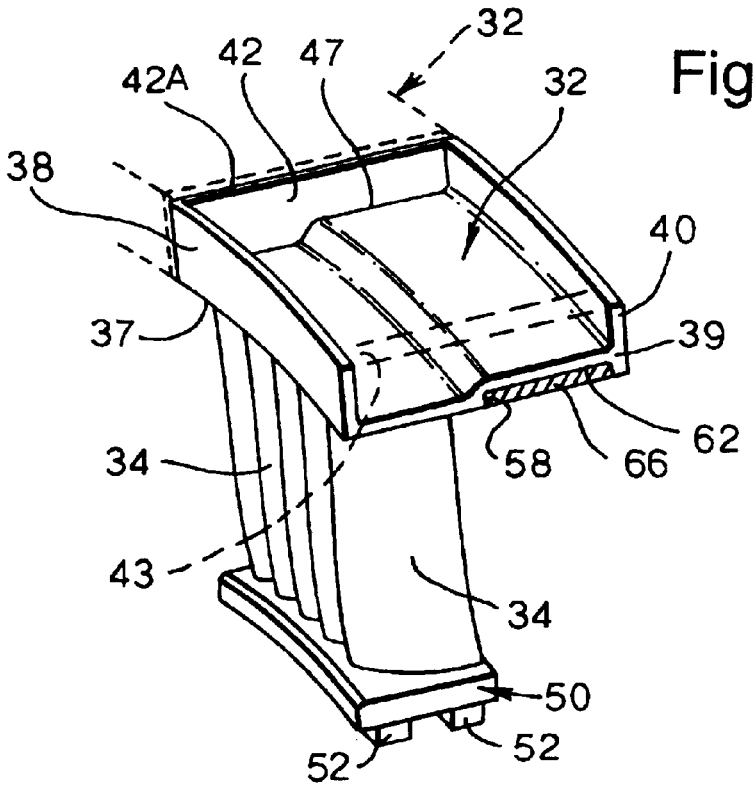
Fig.4.
Fig.5.
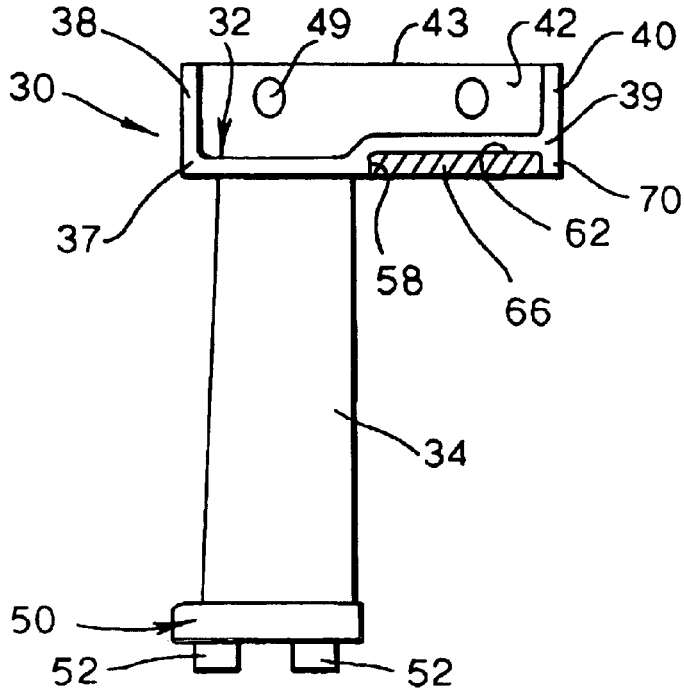

CASING SECTION

FIELD OF THE INVENTION

This invention relates to casing sections. More particularly, but not exclusively, the invention relates to casing sections for casings of gas turbine engine compressors.

BACKGROUND OF THE INVENTION

Compressors for gas turbine engines comprise alternating annular arrays of stator vanes and rotor blades. The casings of the compressors are manufactured with annular slots into which the vanes are slid. The vanes are mounted on a platform. Each vane is made subject to manufacturing tolerances. These small variations in size become cumulative as the vanes are mounted onto the casing. This means that different sized vanes have to be used to ensure a close circumferential fit.

SUMMARY OF THE INVENTION

According to one aspect of this invention there is provided a casing section for a rotary apparatus of a gas turbine engine, characterized by a partially circumferential casing member and a radially inwardly extending vane fixed on the casing member.

Preferably, the casing section comprises a plurality of radially inwardly extending vanes fixed on the casing member. The, or each, vane is preferably integral with the casing member.

The casing section may be formed by casting, and the, or each, vane may be formed during such casting. The casing member and the, or each, vane are preferably cast integrally together.

Securing means is preferably provided to secure the casing section to an adjacent further casing or casing section. Where the further casing section is circumferentially adjacent said casing section, the further casing section is preferably as described above.

The securing means may comprise a flange extending axially across the casing member to secure the casing section to said further circumferentially adjacent casing section. In one embodiment, the securing means may comprise two of said axially extending flanges, one at each axially extending end of the casing member. Each flange may define one or more apertures to receive fastening means, for example bolts therethrough.

In another embodiment, the securing means may include a single flange, such flange being arranged along one of the axially extending edges of the casing member. Preferably, the casing section can be secured to a circumferentially adjacent casing section by suitable attachment means, for example welding or by the use of an appropriate adhesive.

The securing means may further comprise a circumferentially extending flange which may be provided on an appropriate circumferentially extending edge of the casing member for securing the casing section to an article, for example a casing, arranged upstream or downstream of said casing section. The flange may define one or more apertures to receive therethrough fastening means, for example in the form of a bolt to secure the casing section to said axially upstream or downstream casing. Preferably, a flange is defined on each of the upstream and downstream circumferentially extending edges of the casing member.

A radially inner member may be provided on the radially inner end of the, or each, vane. Preferably, the inner member extends across the radially inner ends of the vanes. Said inner member may comprise a platform which may extend across the radially inner ends of said plurality of vanes.

The casing member may have a radially inner face defining a recessed portion. The recessed portion is preferably downstream of the vanes. A lining may be provided in the recessed portion to provide a seal with the rotor blades and prevent air passing over the tips of the blades. Preferably, the lining is abradable to allow the tips of the rotor blades to cut a clearance path therethrough.

In one embodiment, the casing member may include two of said recessed portions and a lining material may be provided in each of the recessed portion. The recessed portions are preferably respectively provided upstream and downstream of the vanes.

A sealing means may extend radially inwardly from the inner member. Preferably, the sealing means provides an air seal.

BRIEF DESCRIPTION OF THE DRAWINGS

Embodiments of the invention will now be described by way of example only, with reference to the accompanying drawings, in which:

FIG. 4 is a perspective view of another embodiment of a casing section;

FIG. 5 is a side view of a casing section shown in FIG. 4.

DETAILED DESCRIPTION OF THE INVENTION

Figure 1:
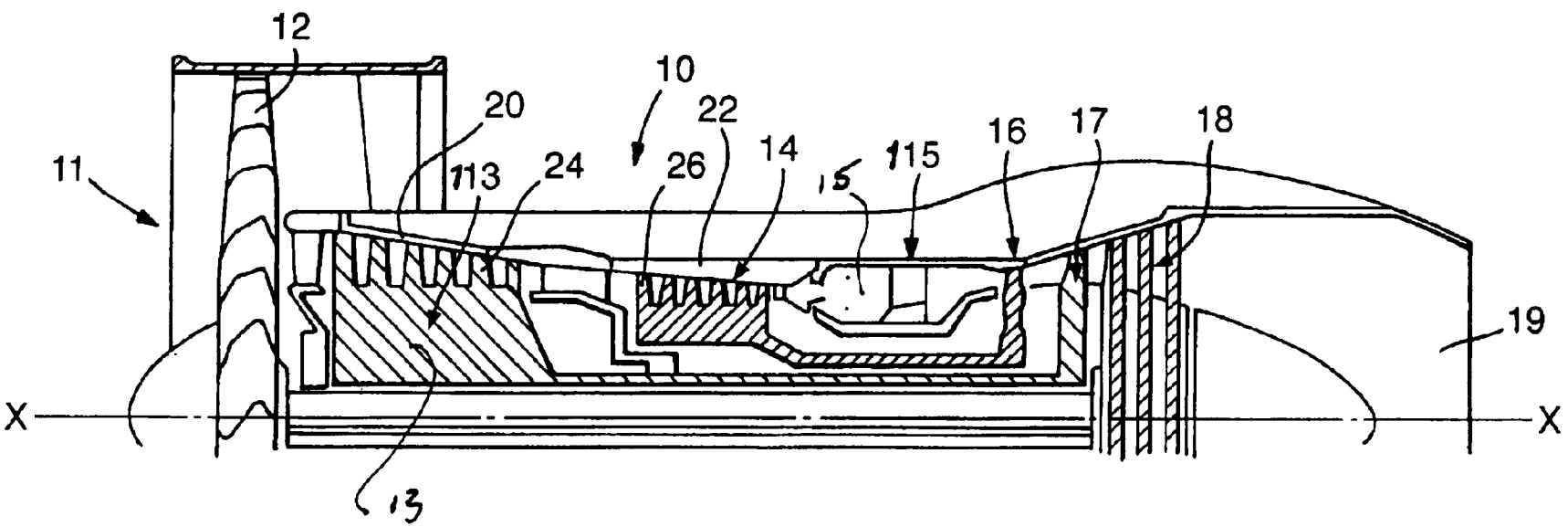
FIG. 1 is a sectional side view of the upper half of a gas turbine engine.

With reference to FIG. 1, a ducted fan gas turbine engine generally indicated at 10 has a principal axis X—X. The engine 10 comprises, in axial flow series, an air; intake 11, a propulsive fan 12, a compressor region 113 comprising an intermediate pressure compressor 13, and a high pressure compressor 14, combustion means 115 comprising a combustor 15, and a turbine region 116 comprising a high pressure turbine 16 an intermediate pressure turbine 17, and a low pressure: turbine 18. An exhaust nozzle 19 is provided at the tail of the engine 10.

The gas turbine engine 10 works in the conventional manner so that air entering the intake 11 is accelerated by the fan to produce two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive the high, intermediate and low pressure turbine 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

The intermediate and high pressure compressors 13, 14 each comprise a casing 20, 22 which circumferentially surrounds and encloses axially alternating annular arrays of rotor blades and stator vanes 34 (see FIGS. 2 to 4), although only the blades 24 of the intermediate pressure compressor 13 and the blades 26 of the high pressure compressor 14 can be seen in FIG. 1.

Figure 2:
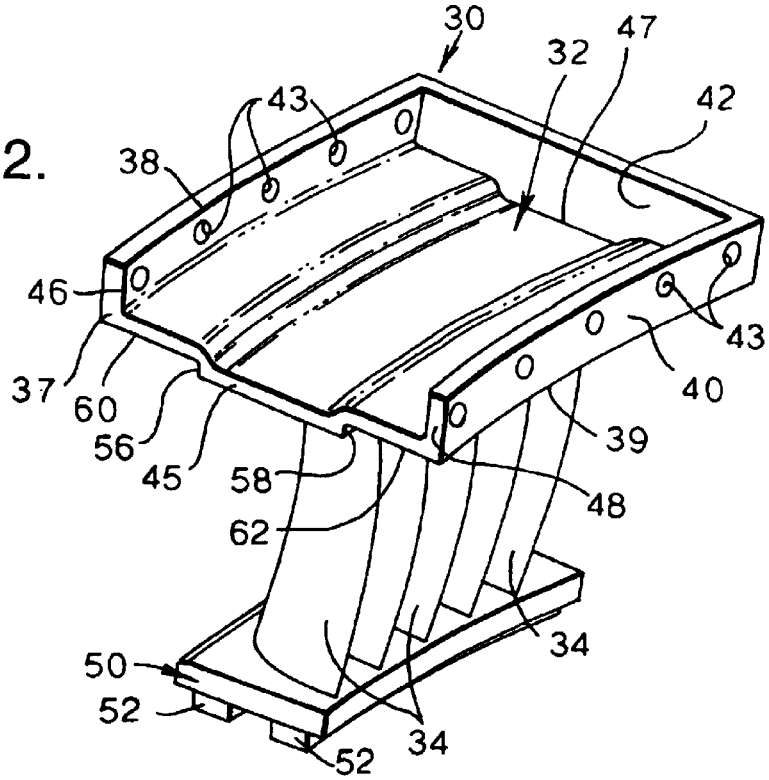
FIG. 2 is a perspective view of one embodiment of a casing section.
Figure 3:
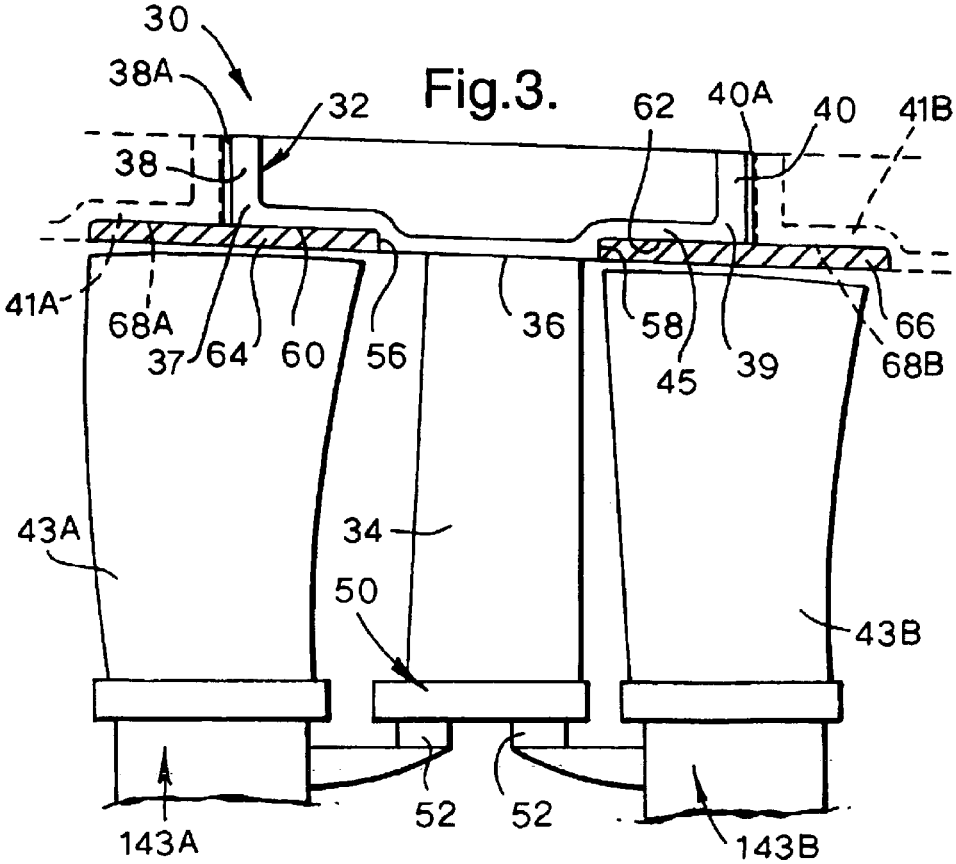
FIG. 3 is a side view of a casing section shown in FIG. 2.

Each of the arrays of stator vanes 34 is formed of a plurality of casing sections 30 arranged in an annular array. Referring to FIGS. 2 and 3, there is shown an embodiment of a casing section 30. Each casing section 30 comprises a casing member 32 and a plurality of radially inwardly extending stator vanes 34 integrally fixed thereon the casing section 30 can be formed by casting, such that the casing member 32 and the vanes 34 are formed integrally by casting.

In the case of the embodiment shown in FIGS. 2 and 3, the casing section 30 has five of said stator vanes 34 which extend radially inwardly from a radially inner face 36 of the casing member 32. A pair of circumferentially extending flanges 38, 40, at the respective upstream and downstream edges 37, 39 of the casing member 32 connect each casing section 30 to respective upstream and downstream casings 41A, 41B (shown in broken lines in FIG. 3) surrounding the respective upstream and downstream arrays of rotor blades 43A, 43B mounted on respective discs 143A, 143B. As can be seen, each of the flanges 38, 40 is provided with a plurality of apertures 43 through which bolts can be received to secure each casing section 30 to the respective upstream and downstream casings 41A, 41B.

The casing section 30 is attached to a circumferentially adjacent further casing section 30 by means of an axially extending flange 42. The casing member 32 has two opposite axially extending edges 45, 47. As can be seen, the casing section 30 comprises a single flange 42 which extends along one of the axially extending edges 47 of the casing member 32. The opposite axially extending edge 45 is devoid of such a flange. In order to attach the casing section 30 to a circumferentially adjacent casing section 30, the flange 42 is welded to the edge 45 of the adjacent casing section 30 and to ends 46, 48 of the respective circumferentially extending flanges 38, 40. In the case of connections between adjacent axially extending, or adjacent circumferentially extending, flanges a gasket 38A, 40A, 42A can be provided to prevent or reduce vibration.

The casing section 30 further includes a circumferentially extending platform 50, which extends across the radially inner ends of the stator vanes 34. The platform 50 of the casing section 30 can be attached to the platform 50 of a circumferentially adjacent further casing section 30 by suitable means, for example welding.

Rubstrips 52 are provided on a radially inner face 54 of the platform 50. The rubstrips 52 sealingly engage members 55A, 55B on the discs 143A, 143B to prevent gas in the engine leaking from the higher pressure downstream region to the lower pressure upstream region.

The radially inner face 36 of the casing member 32 includes two radially outwardly extending shoulders 56, 58. The shoulders 56, 58 are provided respectively upstream and downstream of the stator vanes 34. The shoulders 56, 58 provide respective upstream and downstream recessed portions 60, 62 into which are received abradable linings 64, 66 which provide a seal for the upstream and downstream rotor blades. The upstream and downstream casings 41A, 41B also include respective corresponding recessed portions 68A, 68B, whereby the abradable linings 64, 66 overlap and are received in the respective recessed portions 68A, 68B. The linings 64, 66 provide a seal with the upstream and downstream rotor blades which carve a path through the respective abradable linings 64, 66. Thus, in the event that the linings 64, 66 become worn, the respective casing section can be replaced to replace the lining 64, 66.

Referring to FIGS. 4 and 5 there is shown another embodiment, which comprises many of the same features of the embodiment shown in FIGS. 2 and 3, and these have been designated with the same reference numerals. However, the embodiments shown in FIGS. 4 and 5 differs from that shown in FIGS. 2 and 3 in that only one shoulder 58 and a corresponding recessed portion 62 is provided on the radially inner face 36 of the casing member 32. The recessed portion 62 extends from the shoulder 58 to a radially inwardly extending flange 70 at the downstream edge 39 of the casing member 32. A further difference is that upstream recessed portion 60 in the embodiment shown in FIGS. 2 and 3 is omitted. Also omitted is the part of the casing member 32 upstream of the stator vanes 34. In addition a flange 43 may be provided at the opposite axially extending edge to the flange 42 and both flanges 42, 43 may define apertures 49 for fastening means e.g. bolt or rivets to secure the casing sections together.

The upstream flange 38 is provided immediately upstream of the stator vanes 34.

There is thus described a casing section for use in a gas turbine engine which has the advantage of reducing the part count in the assembly of a compressor, facilitates assembly, stripping, inspection of overhaul, reduces leakage, eliminates the need for selective assembly of the vanes, and does not require refurbishment of the abradable lining or the rod strip, since the casing sections can be replaced.

Various modifications can be made without departing from the scope of the invention. For example, each of the casings could be provided with circumferentially extending flanges at each of the actually extending edges, and these flanges could be provided with apertures for fastening means, for example in the form of bolts to enable circumferentially adjacent casing sections to be attached together.

In addition, although the invention has been described with reference to a compressor, it may also have applications in connection with turbines.

A further modification is that, although the casing has been described as being made of a plurality of casing sections, it will be appreciated that each casing section need not be identical, the number of vanes 34 extending radially inwardly from the casing members 32 may differ from casing section to casing section.

Whilst endeavouring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

What is claimed is:

1. A casing section for a rotary apparatus of a gas turbine engine of the type having a rotor carrying rotor blades, the casing section comprising a partially circumferential casing member, the casing member having at least one radially inwardly extending vane, said vane and said casing section being integrally cast as a unit and the casing member having a radially inner face defining a recessed portion for receiving an abradable lining in the recessed portion to provide a seal with the rotor blades.

2. A casing section according to claim 1 wherein the casing section includes a plurality of said radially inwardly extending vanes, each of which is fixed on the casing member.

3. A casing section according to claim 2 wherein a radially inner member is provided, the inner member extending across the radially inner ends of said plurality of vanes so as to comprise a platform.

4. A casing section according to claim 3 characterised in that a sealing means extends radially inwardly from the inner member to sealingly engage a portion of a support member upon which upstream or downstream rotor blades are supported.

5. A casing section according to claim 1 wherein securing means is provided to secure the casing section to an adjacent further casing or casing section.

6. A casing section according to claim 5 wherein securing means comprises at least one flange extending axially across the casing member to secure the casing section to a further circumferentially adjacent casing section.

7. A casing section according to claim 6 wherein the securing means comprises two of said axially extending flanges, one at each axially extending end of the casing member.

8. A casing section according to claim 7 wherein vibration reducing means are arranged in engagement with said axially or circumferentially extending flanges.

9. A casing section according to claim 8 wherein the vibration reducing means comprises one or more gaskets.

10. A casing section according to claim 6 wherein the, or each, flange defines one or more apertures to receive fastening means therethrough.

11. A casing section according to claim 6 wherein the securing means includes a single flange, such flange being arranged along one of the axially extending edges of the casing member, the casing section being securable to a circumferentially adjacent casing section at said single flange.

12. A casing section according to claim 6 wherein the securing means further includes a circumferentially extending flange provided on a circumferentially extending edge of the casing member for securing the casing section to an article arranged upstream or downstream of said casing section.

13. A casing section according to claim 12 wherein a flange is provided on each of the circumferentially extending edges and each flange defines one or more apertures to receive therethrough fastening means to secure the casing section to said upstream or downstream article.

14. A casing section according to claim 1 wherein a radially inner member is provided on the radially inner end of the, or each, vane, said inner member comprising a platform.

15. A casing section according to claim 1 wherein the casing member has an abradable lining provided in the recessed portion to provide a seal with the rotor blades.

16. A vane assembly comprising a plurality of casing sections as claimed in claim 1 secured to each other in an annular array.

17. Rotary apparatus for a gas turbine engine incorporating a vane assembly as claimed in claim 16.

18. Rotary apparatus according to claim 17 in the form of a compressor.

19. A gas turbine engine incorporating rotary apparatus as claimed in claim 17.

20. A casing section for a rotary apparatus of a gas turbine engine of the type having a rotor carrying rotor blades, the casing section comprising a partially circumferential casing member, the casing member having at least one radially inwardly extending vane, said vane being integrally formed during casting with the casing section wherein the casing member and the at least one vane are cast together as a unit and the casing member having a radially inner face defining a recessed portion for receiving an abradable lining in the recessed portion to provide a seal with the rotor blades characterised in that the casing member includes an abradable lining material provided in each of the recessed portions wherein the recessed portions are respectively provided upstream and downstream of the vanes.

* * * * *